US008356558B2

(12) United States Patent
Jeambey et al.

(10) Patent No.: US 8,356,558 B2
(45) Date of Patent: Jan. 22, 2013

(54) CONSTANT CONTACT SIDE BEARING

(75) Inventors: Jon Jeambey, Naperville, IL (US); Corine Kolenda, Carol Stream, IL (US); Don Kroesch, Minooka, IL (US)

(73) Assignee: TTX Company, Chicago, IL (US)

( * ) Notice: Subject to any disclaimer, the term of this patent is extended or adjusted under 35 U.S.C. 154(b) by 0 days.

(21) Appl. No.: 13/040,669

(22) Filed: Mar. 4, 2011

(65) Prior Publication Data

US 2012/0222581 A1 Sep. 6, 2012

(51) Int. Cl.
*B61F 3/00* (2006.01)

(52) U.S. Cl. ..... 105/199.3; 105/453

(58) Field of Classification Search ..... 105/199.3, 105/199.4, 453; 384/423
See application file for complete search history.

(56) References Cited

U.S. PATENT DOCUMENTS

| | | | | | |
|---|---|---|---|---|---|
| 2,169,616 | A * | 8/1939 | De Los Rice | 105/4.1 |
| 2,576,367 | A * | 11/1951 | Spearman | 105/199.3 |
| 2,756,691 | A * | 7/1956 | Masel et al. | 105/185 |
| 3,601,063 | A * | 8/1971 | Dean | 105/429 |
| 3,730,104 | A * | 5/1973 | Hood, II | 105/199.3 |
| 3,941,061 | A * | 3/1976 | Schindehutte et al. | 105/135 |
| 3,981,548 | A * | 9/1976 | MacDonnell et al. | 384/599 |
| 5,036,774 | A * | 8/1991 | Curtis et al. | 105/4.1 |
| 5,195,438 | A * | 3/1993 | Dumoulin et al. | 105/199.3 |
| 5,806,435 | A * | 9/1998 | Pitchford | 105/199.3 |
| 6,644,214 | B1 * | 11/2003 | Schorr | 105/199.3 |
| 7,121,212 | B2 | 10/2006 | Schorr | |
| 7,527,003 | B1 | 5/2009 | Schorr | |
| 7,546,807 | B2 | 6/2009 | Johnstone | |
| 7,549,379 | B2 | 6/2009 | Monaco | |
| 2004/0129170 | A1 * | 7/2004 | O'Donnell et al. | 105/453 |
| 2005/0087092 | A1 * | 4/2005 | McKisic et al. | 105/199.3 |
| 2008/0035012 | A1 * | 2/2008 | Monaco et al. | 105/199.3 |
| 2008/0035013 | A1 * | 2/2008 | Johnstone et al. | 105/199.3 |
| 2008/0141896 | A1 * | 6/2008 | O'Donnell et al. | 105/199.3 |
| 2008/0173211 | A1 * | 7/2008 | Kennedy | 105/199.3 |

* cited by examiner

*Primary Examiner* — Jason C Smith
(74) *Attorney, Agent, or Firm* — Brinks Hofer Gilson & Lione

(57) ABSTRACT

A constant contact side bearing (CCSB) for use between a truck and car of a rail car that includes a generally hollow housing that includes a closed bottom end and an open top end. An attachment member is attached to an outside surface of the housing and is positioned in a center region between the top end and the bottom end. A resilient member is positioned inside the housing, and a cap is fitted over resilient member and is sized relative to the housing to enable slidibly moving into the housing.

20 Claims, 5 Drawing Sheets

CONSTANT CONTACT SIDE BEARING

BACKGROUND

Rail cars typically consist of a car body, where cargo is loaded, and a pair of trucks, which are wheel and suspension assemblies upon which the car rests. The truck is configured to match the rails upon which the rail car moves. The connection between the car body and the trucks enables the car body to roll relative to the trucks and allows the truck to swivel, or yaw, relative to the car body. The connection may include centerplates or bearings and a pair of pins positioned on opposite ends of the bottom of the car. The pins and centerplates are configured to enter corresponding openings in the trucks. The car body-truck connection is intended to permit passive steering of the wheelsets and allow the trucks and car to follow the track without derailing. One problem with this connection configuration is that it may lead to a phenomenon known as "hunting," which is a resonant condition exhibited by the car in response to the forces from the wheel/rail interaction at certain speeds. This resonance condition is evidenced by greatly increased lateral and yaw motions of the truck and car body, leading to increased wear of truck and track components. The resulting increased movement also increases stress on the rails.

In an effort to reduce hunting, (resonance) and thereby stress on the rails, constant contact side bearings (CCSBs) have been mandated on newer rail cars. CCSBs help reduce hunting by increasing the yaw moment between the truck and car body. The CCSBs are positioned on sides of the truck, below a wear plate positioned on the underside of the car. The cap serves as a bearing surface upon which the wear plate is in constant contact. Friction between the cap and wear plate increases the yaw moment of the truck. A resilient member beneath the cap provides the vertical force to keep the cap in constant contact with the wear plate. The side bearing must displace vertically to allow car body roll relative to the truck.

One problem with known CCSB arrangements is that the space between the upper surface of the bolster of the truck, or when used, the side bearing pedestal fixed to the bolster, and the wear plate of the car body is limited, thereby restricting the height of the CCSB to the distance between the upper surface of the bolster, or side bearing pedestal, and the car body wear plate. The limited space makes it challenging to find a resilient member with characteristics suited to withstand long term stresses encountered during operation of the rail car.

BRIEF SUMMARY

An object of the invention is to provide a constant contact side bearing (CCSB) for use between a truck and car of a rail car that overcomes the problems identified above. The CCSB includes a generally hollow housing that includes a closed bottom end and an open top end. An attachment member is attached to an outside surface of the housing and is positioned in a center region between the top end and the bottom end. A resilient member is positioned inside the housing, and a cap is fitted over the resilient member and is sized relative to the housing to enable slidable movement within the housing.

Another object of the invention is to provide a method for manufacturing the constant contact side bearing (CCSB) described above. The method includes providing a generally hollow housing that includes a closed bottom end and an open top end. The method further includes attaching an attachment member to an outside surface of the housing, in a center region between the top end and the bottom end. A resilient member is positioned inside the housing and covered with cap configured to slide into the housing.

Yet another object of the invention is to provide a truck and CCSB assembly. The assembly includes a side bearing pedestal with an upper surface that defines one or more openings sized to enable at least a portion of a CCSB to extend through the upper surface of the side bearing pedestal supporting the CCSB. Each CCSB includes a generally hollow housing that includes a closed bottom end and an open top end, and an attachment member attached to an outside surface of the housing in a center region between the top end and the bottom end. A resilient member is positioned inside the housing, and a cap covers the resilient member and is configured to slide into the housing.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

The exemplary embodiments below describe a constant contact side bearing (CCSB) configured to be positioned between an upper surface of the CCSB pedestal of a truck of a rail car and a wear plate positioned below the car portion of the rail car. Generally, the length of the CCSB is greater than the distance between the upper surface of the bolster and the wear plate and the side bearing pedestals configured to enable placement of a resilient member better suited to handling the stresses encountered during the operational life of a rail car. An opening may be formed in the upper surface of the CCSB pedestal to accommodate the longer CCSB.

Figure 1A:
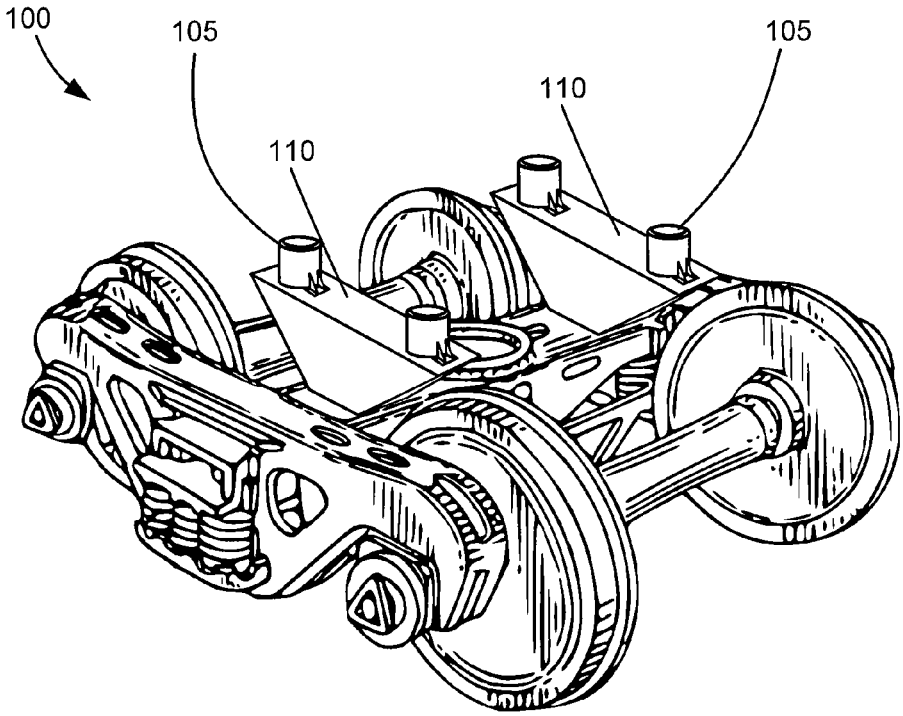
FIGS. 1A and 1B illustrate perspective views of a truck of a rail car that includes a pair of CCSBs in accordance with an embodiment.
Figure 1B:
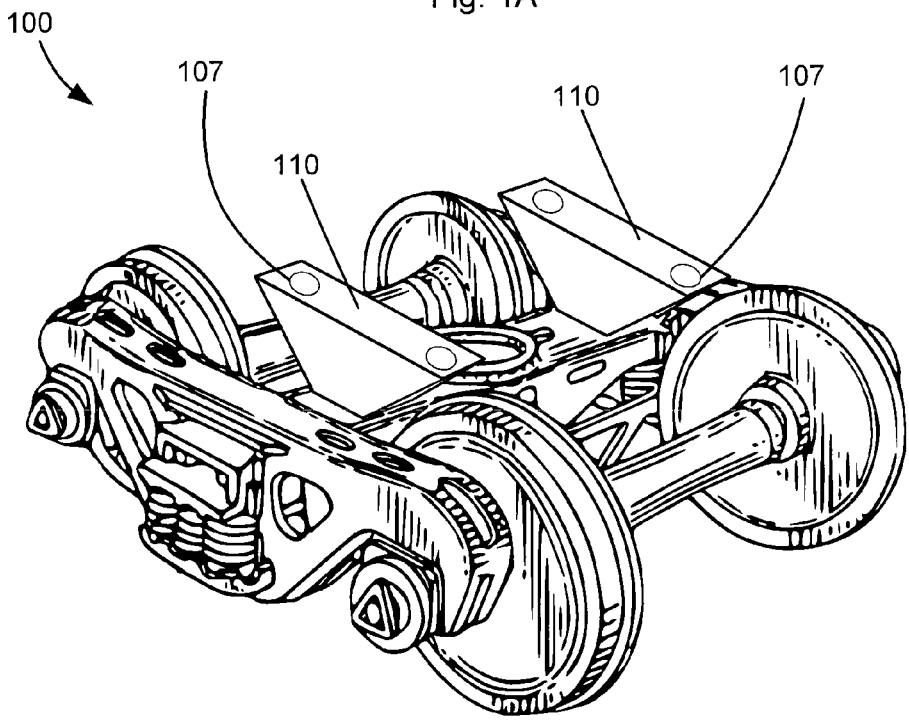

FIGS. 1A and 1B illustrate perspective views of a truck 100 of a rail car. Referring to FIG. 1A, attached to the truck is a pair of constant contact side bearings (CCSBs) 105. The CCSBs 105 are attached to an upper surface of a side bearing pedestal 110 fixed to the bolster of the truck 100 and extend through an opening 107 (FIG. 1B) defined in the upper surface of the pedestal 110. For example, the CCSBs 105 may be screwed or welded to the upper surface pedestal 110 or attached by other means known to those skilled in the art.

Figure 2:
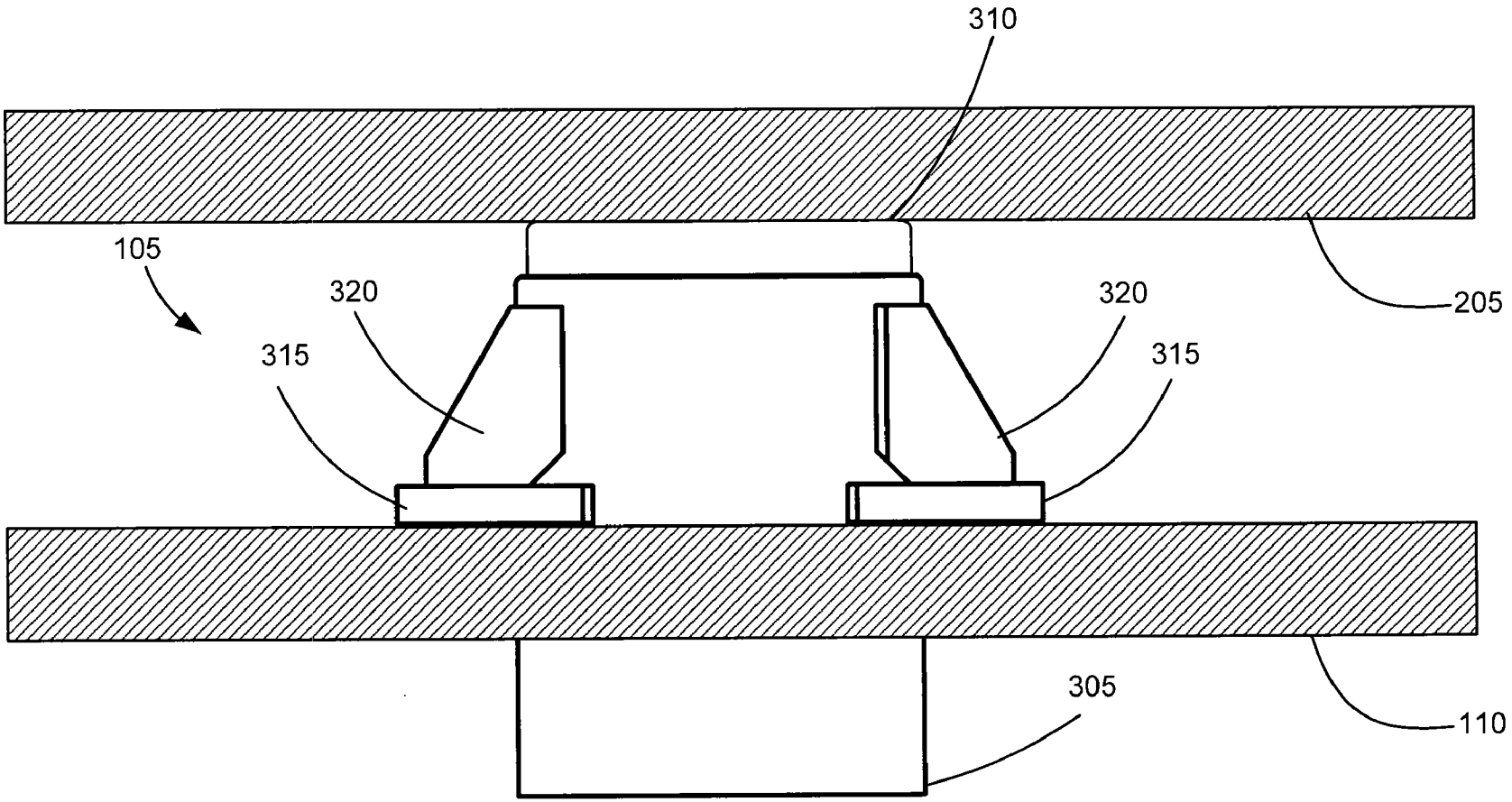
FIG. 2 illustrates a side view of an exemplary CCSB positioned between an upper surface of the CCSB pedestal of a truck and a wear plate of a car.

Referring to FIG. 2, a cap 310 of the CCSB 105, described below, is configured to contact a metallic wear plate 205 positioned on the underside of a rail car (not shown). A pair of openings 107 (FIG. 1*b*) may be formed in the upper surface of the pedestal 110. The openings enable insertion of the CCSBs 105 into the upper surface of the pedestal 110 so that each CCSB 105 at least partially extends through the upper surface of the pedestal 110. That is, the CCSB 105 extends through the plane of the upper surface. The diameters of the openings 107 may be sized slightly larger than the diameter of the CCSBs 105 to accommodate insertion of the CCSBs 105. The openings 107 enable placement of a CCSB 105 that is longer than known CCSBs.

Figure 3A:
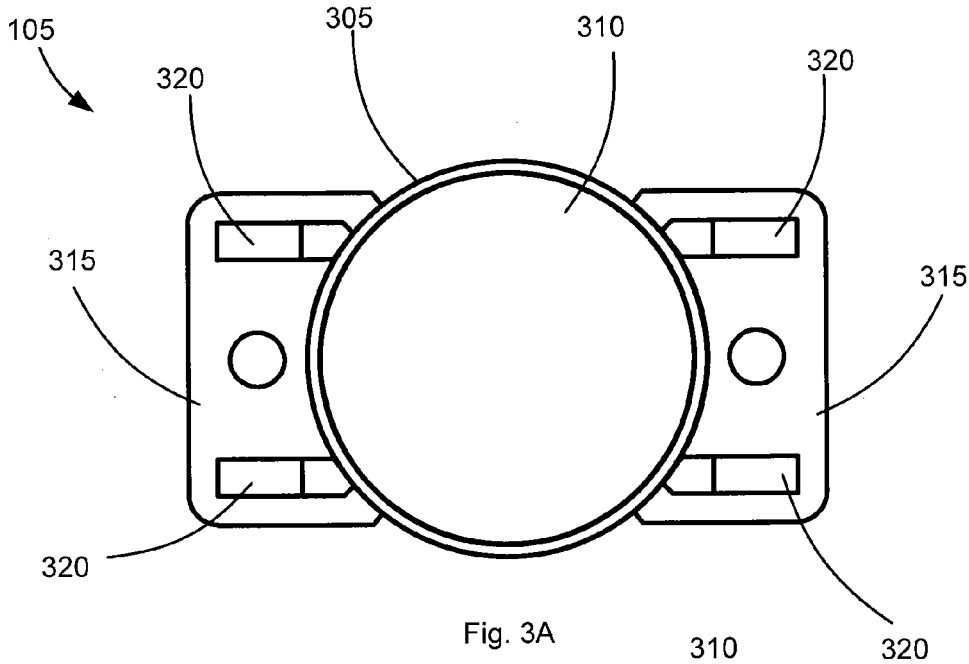
FIGS. 3A and 3B illustrate top and side views, respectively, of the exemplary CCSB.
Figure 3B:
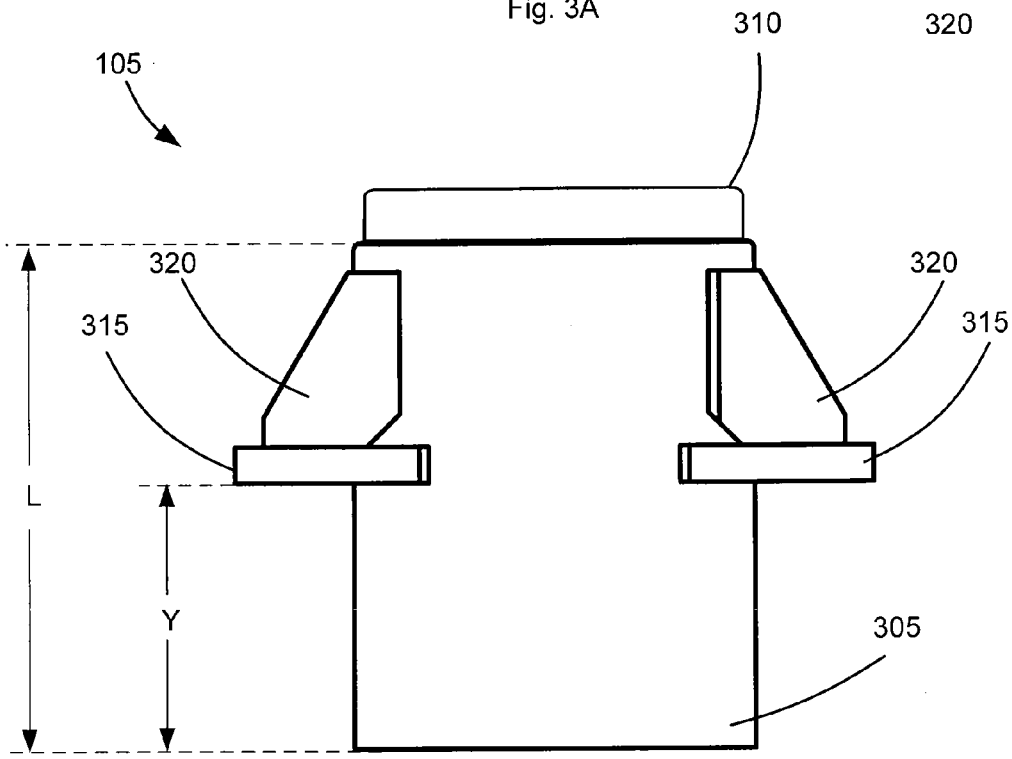

FIGS. 3A and 3B illustrate top and side views, respectively, of an exemplary CCSB 105 that may correspond to the CCSBs 105, described above. The CCSB 105 includes a housing 305, an attachment member 315, and a cap 310. The housing 305 may have a cylindrical shape or a different shape. The length L of the housing 305 between the bottom and top ends may be about 8 inches, which is longer than known CCSBs, which may be about 4 inches. The length L may be shorter or longer depending on the type and configuration of the resilient member. As described below, the increased length enables placement of a resilient member that is longer than resilient members in known CCSBs. The longer resilient member exhibits reduced stress during the operational life of the rail car when compared to resilient members used in known CCSBs. The bottom end of the housing 305 is generally closed and the top end is open to enable insertion of the cap 310.

The cap 310 is configured to slide into and out of the top end of the housing 305. The cap 310 may have the same general shape as the housing 305 albeit sized slightly smaller to enable the cap 310 to move freely within the housing 305. For example, when viewed from the top, the cap 310 may have a circular shape with an outer diameter slightly smaller than an inner diameter of the housing 305.

The attachment member 315 is attached to the housing 305. In some embodiments, the attachment member 315 is welded to the housing 305. In other embodiments, the attachment member 315 may be formed integrally with the housing 305 in a single process, such as a casting process or other process known to one skilled in the art. The attachment member 315 may be attached in a center region of the housing 305 that is between the bottom and top ends of the housing 305. For example, the distance Y between the attachment member 315 and the bottom end of the housing 305 may be about 4 inches. The distance Y may be different and may be configured so that the bottom end of the housing 305 extends through an opening in an upper surface of a pedestal when the CCSB is attached to the pedestal.

The attachment member 315 is configured to attach to an upper surface of a pedestal 110 that is fixed to a bolster on a truck 100 to secure the CCSB 105 to the truck 100. For example, the attachment member 315 may be welded to the upper surface of the pedestal 110 of the truck 100, or attached via fasteners, such as bolts and the like, which may pass through openings defines on the attachment member. In some implementations, gussets 320 may be attached (e.g., welded) to the attachment member 315 and the housing 305 to strengthen the joint between the housing 305 and the attachment member 315.

Figure 4:
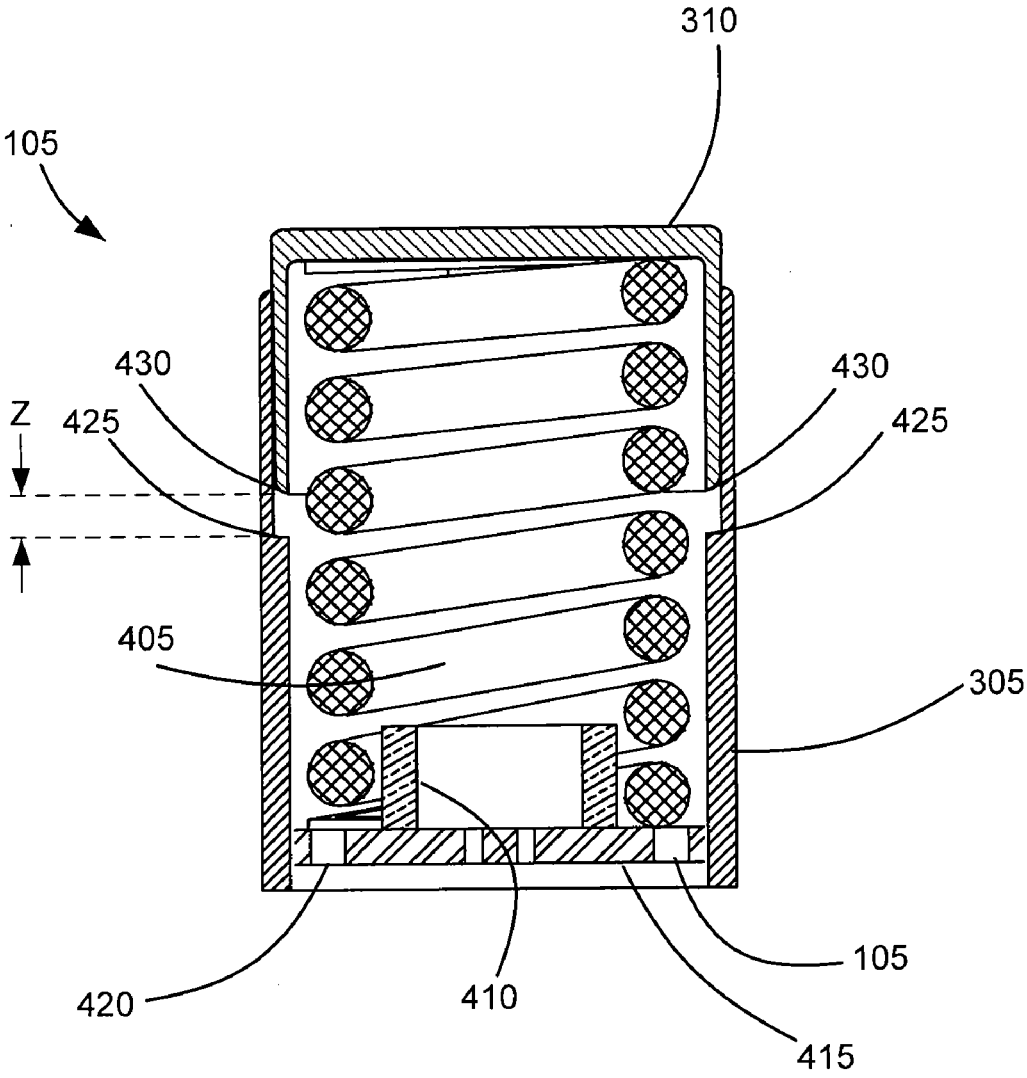
FIG. 4 illustrates the interior of the exemplary CCSB.

FIG. 4 illustrates the interior of the CCSB 105 described above. Referring to FIG. 4, a resilient member 405 is positioned within the housing 305. The resilient member 405 may be a coil spring, such as a D5 spring known to those skilled in the art. The spring may be different and may be a metal spring, plastic spring, or a spring made from a different material suitable to withstand the stresses encountered during the operation life of the CCSB. In some implementations, the coil spring may include 6 coils. However, a spring with a different number of coils may be used. The greater the number of coils, the more distributed the stress throughout the resilient member 405. Reduced stress in the resilient member 405 results in increased operating life of the CCSB 105.

The cap 310 is configured to rest upon the resilient member 405. In a non-compressed position, a bottom end 430 of the cap 310 is separated by a distance Z of about 0.625 inches from a ledge 425 defined on the interior surface of the housing 305. The ledge 425 is configured to limit the amount by which the cap 310 enters the housing 305. However, the distance between the bottom end 430 of the cap 310 and the ledge 425 may be increased or decreased accordingly to change the amount of travel available to the cap 310.

A bottom plate 415 is positioned inside of the housing 305 towards a bottom end. The bottom plate 415 includes one or more openings 420. The openings 420 are configured to prevent the accumulation of liquids, such as rain water, within the CCSB 105. In some implementations, a tubular member 410 may be positioned on the bottom plate 415. The tubular member 410 may be hollow and configured to center the resilient member 405 within the housing 305 to prevent lateral movement of the resilient member 405 and, therefore, contact between the resilient member 405 and vertical interior sides of the housing 305. The outer diameter of the tubular member 410 may be about the same as the inner diameter of the resilient member 405, albeit slightly smaller, to enable a snug fit.

Figure 5:
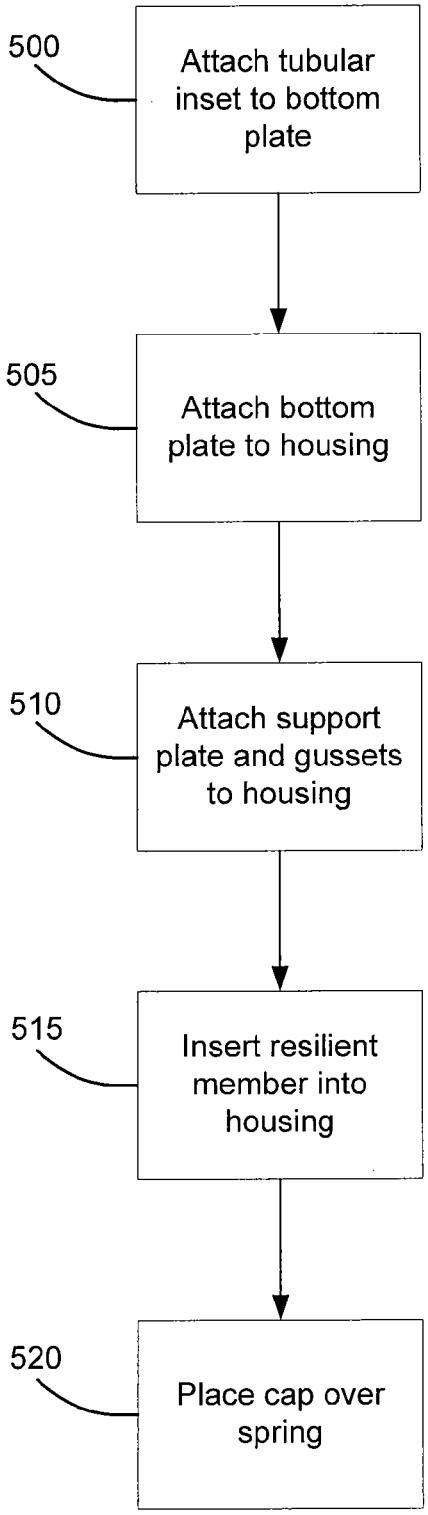
FIG. 5 illustrates exemplary operations for assembling the exemplary CCSB described above.

FIG. 5 illustrates exemplary operations for assembling the CCSB described above. At block 500, an optional tubular member 410 may be attached to a bottom plate 415. For example, the tubular member 410 may be welded to the bottom plate 415. Alternatively, the tubular member and bottom plate 415 may be formed in a single process, such as a casting process or a different process known to one skilled in the art.

At block 505, the bottom plate 415 with the optionally attached tubular member 410 may be attached to the housing 205 by, for example, welding the two portions together.

At block 510, the attachment member 315 and optional gussets 320 may be attached to the outside of the housing 205 by, for example, welding the portions together.

At block 515, the resilient member 405 may be inserted into the housing 205, and over the tubular member 410, if present.

At block 520, the cap 310 may be placed over the resilient member 405 to complete assembly of the CCSB.

In subsequent operations, the assembled CCSB 105 may be attached to an upper surface of the bolster 110 of a truck 100. Openings for receiving the CCSB 105 may be formed in the upper surface of the bolster 110 to allow for the increased length of the CCSB 105.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A constant contact side bearing for use between a truck and car of a rail car comprising:

a generally hollow housing that includes a closed bottom end and an open top end;

an attachment member attached to an outside surface of the housing, the attachment member comprises first and second extensions that extend perpendicularly away from the outside surface of the housing from a region of the housing that is between the top end and the bottom end, and first and second gussets that extend between upper surfaces of the respective extensions and the outside surface of the housing, wherein the attachment member is configured to attach to an upper surface of a pedestal that is arranged on a top surface of a bolster of the truck and to extend through an opening defined in an upper surface of the pedestal;

a resilient member positioned inside the housing; and a cap configured to cover the resilient member and slide into the housing.

2. The constant contact side bearing according to claim 1, wherein a distance between the top end and the bottom end of the housing is at least about 8 inches.

3. The constant contact side bearing according to claim 1, wherein a distance between the bottom end and the attachment member is at least about 4 inches.

4. The constant contact side bearing according to claim 1, wherein the resilient member Is a coil spring that includes at least 6 coils.

5. The constant contact side bearing according to claim 1. wherein the coil spring is a D5 spring.

6. The constant contact side bearing according to claim 1, further comprising a tubular member extending inwardly from the bottom end sized to center the resilient member within the housing.

7. The constant contact side bearing according to claim 1, wherein the bottom end defines at least one opening sized to prevent the accumulation of a liquid within the housing.

8. The constant contact side bearing according to claim 1, wherein the housing is a generally cylindrical housing with a substantially constant diameter between the dosed bottom end the open top end, wherein the housing defines a ledge on an interior surface configured to limit an amount by which the cap enters the housing.

9. A method for manufacturing a constant contact side bearing for use between a truck and car of a rail car comprising:

providing a generally hollow housing that includes a closed bottom end and an open top end;

attaching an attachment member to an outside surface of the housing, wherein the attachment member comprises first and second extensions that extend perpendicularly away from the outside surface of the housing from a region of the housing that is between the first end and the second end, and first and second gussets that extend between upper surfaces of the respective extensions and the outside surface of the housing, wherein the attachment member is configured to attach to an upper surface of a pedestal that is arranged on a top surface of a bolster of the truck and extend through an opening defined in an upper surface of the pedestal;

inserting a resilient member inside the housing; and covering the resilient member with a cap configured to slide into the housing.

10. The method according to claim 9, wherein a distance between the top end and the bottom end of the housing is about 8 inches.

11. The method according to claim 9, wherein a distance between the bottom end and the attachment member is about 4 inches.

12. The method according to claim 9, wherein the resilient member is a coil spring that includes at least 6 coils.

13. The method according to claim 9, wherein the coil spring is a D5 spring.

14. The method according to claim 9, further comprising attaching a tubular member configured to center the resilient member to an inside surface of the bottom end of the housing.

15. The method according to claim 9, wherein the bottom end defines at least one opening sized to prevent the accumulation of a liquid within the housing.

16. The method according to claim 9, wherein the housing defines a ledge on an interior surface configured to limit an amount by which the cap enters the housing.

17. A rail car comprising:

a truck that includes a side bearing pedestal fixed to a bolster, the side bearing pedestal having formed therein one or more openings, each of the one or more openings is sized to enable at least a portion of a constant contact side bearing to extend through the upper surface of the side bearing pedestal; and one or more constant contact side bearings (CCSB) positioned on the upper surface of the side bearing pedestal, each CCSB including:

a generally hollow housing that includes a closed bottom end and an open top end;

an attachment member attached to an outside surface of the housing, the attachment member being positioned in a center region between the first end and the second end so that the one ore more CCSBs at least partially extend through the one or more openings, wherein the attachment member is configured to be attached to the upper surface of the side bearing pedestal;

a resilient member positioned inside the housing; and a cap configured to cover the resilient member and slide into the housing.

18. The rail car according to claim 17, wherein a distance between the top end and the bottom end of the housing is about 8 inches.

19. The rail car according to claim 17, wherein the one or more CCSBs includes two CCSBs, wherein the two CCSBs are Positioned on a top surface of the pedestal and spaced apart another to provide two separate bearing surfaces.

20. The rail car according to claim 17, wherein the resilient member is a coil spring that includes at least 6 coils.

* * * * *

UNITED STATES PATENT AND TRADEMARK OFFICE

CERTIFICATE OF CORRECTION

PATENT NO. : 8,356,558 B2
APPLICATION NO. : 13/040669
DATED : January 22, 2013
INVENTOR(S) : Jon Jeambey et al.

It is certified that error appears in the above-identified patent and that said Letters Patent is hereby corrected as shown below:

In the Claims

In column 6, claim 19, line 52, before "another to provide two" insert --from one--.

Signed and Sealed this
Fifteenth Day of October, 2013

Teresa Stanek Rea
*Deputy Director of the United States Patent and Trademark Office*